US007784761B2

(12) United States Patent
Ma

(10) Patent No.: US 7,784,761 B2
(45) Date of Patent: Aug. 31, 2010

(54) UMBRELLA BASE CLAMP

(76) Inventor: Oliver Joen-an Ma, 29 W. Wisteria, Arcadia, CA (US) 91007

( * ) Notice: Subject to any disclaimer, the term of this patent is extended or adjusted under 35 U.S.C. 154(b) by 924 days.

(21) Appl. No.: 11/357,514

(22) Filed: Feb. 17, 2006

(65) Prior Publication Data

US 2006/0231722 A1 Oct. 19, 2006

(30) Foreign Application Priority Data

Feb. 18, 2005 (CN) ..... 2005 2 0039686 U

(51) Int. Cl.
*F16M 13/00* (2006.01)

(52) U.S. Cl. ..... 248/523; 135/16; 403/104

(58) Field of Classification Search ..... 248/519, 248/522, 523, 159, 188.2, 188.1, 910; 403/104, 403/109.3, 109.5, 110–112; 473/481, 483, 473/398; 135/16
See application file for complete search history.

(56) References Cited

U.S. PATENT DOCUMENTS 1,394,631 A * 10/1921 Luschka et al. ..... 248/650
2,111,642 A 2/1937 Saier
3,119,588 A * 1/1964 Keats ..... 248/158
4,238,164 A * 12/1980 Mazzolla ..... 403/109.5
4,260,365 A 4/1981 Kayne
4,269,010 A 5/1981 Glass
4,541,139 A * 9/1985 Jones et al. ..... 15/171
4,715,089 A * 12/1987 Schema ..... 16/429
4,793,611 A 12/1988 Thornell
4,928,620 A * 5/1990 Currey ..... 114/363
5,337,989 A 8/1994 Apple
5,354,031 A 10/1994 Bilotti
5,375,938 A * 12/1994 Bartlow ..... 403/202
5,383,644 A 1/1995 Huse
5,462,248 A * 10/1995 Bauer ..... 248/161
5,803,643 A * 9/1998 Patelli et al. ..... 403/109.1
5,807,049 A * 9/1998 Beck et al. ..... 411/31
5,848,502 A 12/1998 Schaefer
6,027,309 A 2/2000 Rawls et al.
6,113,054 A 9/2000 Ma
6,405,991 B1 6/2002 Damiano
6,446,408 B1 9/2002 Gordin et al.
6,540,194 B2 4/2003 Schmitt (Continued)

FOREIGN PATENT DOCUMENTS

DE 93 13 372 U1 10/1993

(Continued)

OTHER PUBLICATIONS

EP Extended Search Report regarding EP App. No. 06250886.6 dated Dec. 20, 2007 in 9 pages (021 VEP).

*Primary Examiner*—Korie Chan
(74) *Attorney, Agent, or Firm*—Knobbe, Martens, Olson & Bear, LLP

(57) ABSTRACT

A base assembly is provided that includes a base and a coupler. The coupler includes a sleeve for receiving an umbrella pole, a lower portion comprising a side surface, and a locking member coupled with the side surface. The locking member is configured to move toward or away from a longitudinal axis of the sleeve such that the locking member engages the base to prevent rotation of the coupler relative to the base.

35 Claims, 4 Drawing Sheets

U.S. PATENT DOCUMENTS

| | | | | |
|---|---|---|---|---|
| 6,612,534 | B2 | 9/2003 | Hennessey | |
| 6,892,991 | B1 * | 5/2005 | Soh | 248/188.2 |
| 2002/0053631 | A1 | 5/2002 | Li | |
| 2002/0120238 | A1 * | 8/2002 | McGuckin et al. | 604/187 |
| 2002/0185582 | A1 | 12/2002 | Li | |
| 2004/0108439 | A1 | 6/2004 | Ma | |

FOREIGN PATENT DOCUMENTS

| | | |
|---|---|---|
| EP | 0060957 A2 | 9/1982 |
| EP | 0060957 A3 | 9/1982 |
| EP | 0818594 | 1/1998 |
| EP | 0822305 | 2/1998 |

* cited by examiner

UMBRELLA BASE CLAMP

CROSS-REFERENCE TO RELATED APPLICATIONS

This application claims priority under 35 U.S.C. §119(a) to Utility Model No. 200520039686.1, filed Feb. 18, 2005 in the People's Republic of China, which is hereby expressly incorporated herein by reference in its entirety.

BACKGROUND OF THE INVENTION

1. Field of the Invention

This application relates to the umbrellas and more particularly to clamp assemblies for securing an umbrella pole to an umbrella base and to secure a rotational orientation therebetween.

2. Description of the Related Art

Umbrellas are widely used to provide shade and other weather protection and are frequently employed in an outdoor or patio type setting. Many umbrellas include a deployable canopy portion which is supported by an elongate umbrella pole. In many applications, it is desired to mount or support the pole on an umbrella base. An umbrella pole can be permanently affixed to an umbrella base or can be attached in a removable or nonpermanent manner. In certain applications, it can be desirable that a nonpermanent connection between an umbrella pole and an umbrella base inhibit unwanted rotation between the canopy and umbrella pole and the umbrella base once the connection is made. For example, an umbrella assembly can be configured to tilt or be inclined at an angle such that the arrangement of the umbrella is vertically asymmetric. In such an application, it would often be desirable that this asymmetric arrangement be maintained by inhibiting unwanted rotation of the umbrella pole relative to the umbrella base. For example wind forces might urge the umbrella pole to turn and shift a desired arrangement.

As another example, connection or engagement between the umbrella pole and an umbrella base can occur via a threaded engagement. It would generally be desirable once the umbrella pole is threaded into engagement with the umbrella base to avoid further rotation of the umbrella pole which might tend to loosen the engagement between the pole and the base. Rotation may result in damage or dislodgement of the umbrella. As mentioned, unwanted rotation of the umbrella pole relative to an umbrella base can be induced by wind forces which can induce the umbrella to turn or twist. Unwanted movement of the umbrella pole can also be induced by incidental contact of users or passer bys with the umbrella structure.

SUMMARY OF THE INVENTION

It will be appreciated that there is a need and desire for securing structures or mechanisms for umbrella base and umbrella pole connections that inhibit or reduce unwanted rotational movement therebetween once a connection is made. As umbrellas are often consumer items, such a securing structure or mechanism advantageously is relatively simply in operation, inexpensive to produce and implement, as well as rugged and reliable. As umbrellas are also frequently consumer items valued for their aesthetic appeal, it would be further desirable for such a securing structure or mechanism to present a pleasing aesthetic or unobtrusive visual appearance.

In one aspect, an umbrella base assembly is provided that includes a base, a coupler, a first clamping mechanism, and a second clamping mechanism. The base includes a recess and at least one channel in the recess. The coupler has a sleeve that extends along a longitudinal axis and that is configured to receive an umbrella pole. The coupler has an outer surface and at least one protrusion coupled with the outer surface. The first clamping mechanism is for preventing rotation of the coupler relative to the base. The first clamping mechanism includes the at least one channel in the base and the at least one protrusion. The first clamping mechanism can be engaged by inserting the umbrella pole into the sleeve to a position adjacent to the at least one protrusion. The second clamping mechanism is for preventing rotation of the umbrella pole relative to the coupler. The second clamping mechanism includes a collar and a wedge member positionable at least partially within the collar. The second clamping mechanism is engagable by advancing the collar into engagement with the wedge member such that pressure is applied to the wedge member.

In one aspect, a support for an umbrella pole is provided. The support includes a base, a pole, and a clamp assembly. The pole has a longitudinal axis that extends between a lower end and an upper end. The pole is configured to be inserted into the base. The clamp assembly is for engaging the pole with the base. The clamp assembly includes a plurality of channels formed on an interior surface of the base and at least one protrusion configured to be urged by the pole away from the longitudinal axis and into engagement with one or more of the channels.

In another aspect, a base assembly is provided that includes a base and a coupler. The coupler includes a sleeve for receiving an umbrella pole, a lower portion comprising a side surface, and a locking member coupled with the side surface. The locking member is configured to move toward or away from a longitudinal axis of the sleeve such that the locking member engages the base to prevent rotation of the coupler relative to the base.

In another aspect, a coupler for coupling a lower portion of an umbrella pole with a base is provided. The coupler includes a sleeve for receiving the umbrella pole, a lower portion comprising a side surface, and at least one protrusion movably coupled with the side surface to move away from a longitudinal axis of the sleeve such that the protrusion engages the base.

In another aspect, a support for an umbrella pole is provided that includes a base, a pole, means for coupling the pole with the base, and means for preventing relative rotation between the coupling means and the base. The base comprises a recess. The pole comprises a longitudinal axis, extends between a lower end and an upper end, and is insertable into the recess. The mean for preventing relative rotation is located in, e.g., entirely in, the recess.

Another aspect provides features whereby components of an umbrella base can be separable, providing advantages for shipment and storage. In some aspects, separable components of a base are provided with a mechanism or structure to prevent relative rotation.

In other aspects, an anti-rotation mechanism is provided that is activated by insertion of a pole into a portion of a base. Such activation can involve preventing disengagement of a locking member on a first portion of a base with a notch or channel formed in a second portion of the base. Disengagement can be prevented by blocking movement of the locking member toward a central axis of an umbrella pole.

In some aspects, multiple anti-rotation mechanism are provided, e.g., a first anti-rotation mechanism to prevent relative rotation of first and second portions of a base and a second anti-rotation mechanism to prevent relative rotation of an umbrella pole and a portion of a base.

These and other objects and advantages of the invention will become more apparent from the following description taken in conjunction with the accompanying drawings.

DETAILED DESCRIPTION OF THE PREFERRED EMBODIMENT

Figure 1:
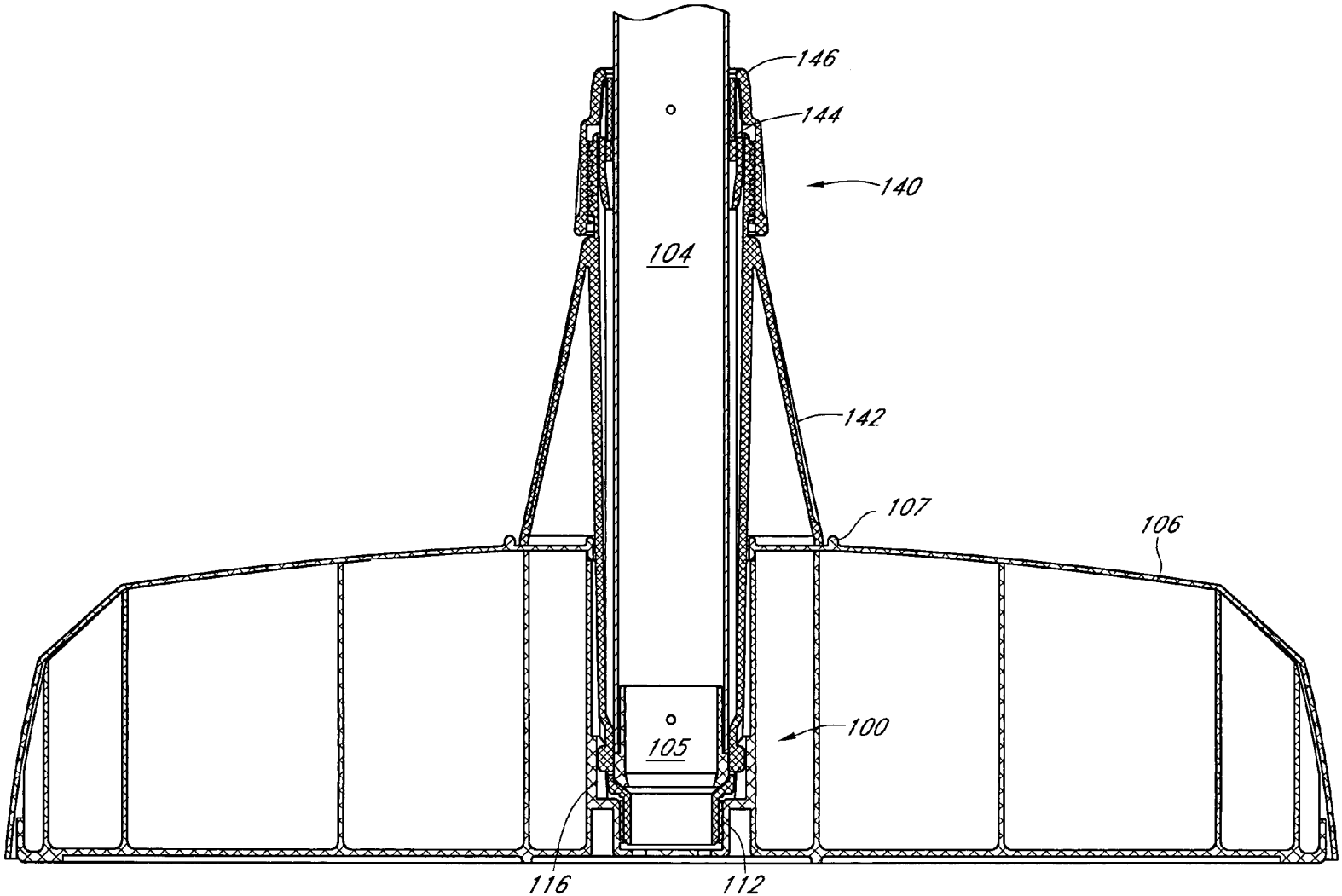
FIG. 1 is a vertical cross-section view one embodiment of an umbrella base clamp.

Reference will now be made to the drawings wherein like reference numerals refer to like parts throughout.

FIG. 1 illustrates a side section view of one embodiment of an umbrella base clamp assembly 100. The umbrella base clamp 100 is configured to secure an umbrella pole 104 to an umbrella base 106 to restrict or inhibit unwanted rotational movement therebetween. The umbrella pole 104 can take any suitable form. In one embodiment, the pole 104 is a generally hollow structure that can have a cap 105 positioned at a lower end thereof. The cap 105 can be made of any suitable material, e.g., aluminum or another metal or a plastic material. In one embodiment, the umbrella base clamp assembly 100 comprises a first clamp assembly which can cooperate with a second umbrella base clamp assembly such as the assembly 140 or the assembly 140' which will be described in greater detail below.

The umbrella base 106 is configured to receive a material to increase the weight thereof, e.g., to be filled with water, sand, or another substance that can be easily dispensed into cavities formed in the base. This construction enables the base 106 to be relatively light for shipping but heavy enough to prevent the umbrella from tipping over. In one embodiment, the base 106 has a ridge 107 for preventing water from flowing into a coupler recess, discussed below. The ridge 107 can be a circular ridge that surrounds, e.g., is a little larger than the outer periphery of a lower end of a pedestal of a coupler for coupling the base 106 with the pole 104, as discussed below.

In this embodiment, the umbrella base clamp assembly 100 comprises a stem 102 that is configured to engage with a lower end of the umbrella pole 104 and also to engage with the base 106. The stem 102 is one embodiment of a pole and base coupler that can be provided between the pole 104 and the base 106 to couple a lower portion of the umbrella pole with the umbrella base. In one embodiment, the stem 102 comprises a threaded portion 110 that is configured to threadedly engage with a threaded portion 112 of the base 106. In one embodiment, the stem 102 also defines a tapered profile 114 that is configured to cooperatively engage with a corresponding tapered profile 116 of the base. The cooperating tapered profiles 114, 116 cooperate to more securely interconnect the stem 102 with the base 106 and thereby with the umbrella pole 104. The cooperating tapered profiles 114, 116 can for example provide a wedging action to accommodate possible wear between the stem 102 and base 106.

In one embodiment, the stem 102 also comprises one or more locking tabs or teeth 120. In one embodiment, the stem 102 comprises two opposed locking tabs 120 arranged on opposite sides of the stem 102. In this embodiment, the locking tab 120 is configured for resilient preloading or biasing to move away from a longitudinal axis of the stem 102 and pole 104. In one embodiment, this resilient preloading or biasing is provided by forming the locking tab 120 of a resilient material, such as plastic and forming the locking tab 120 to be at least partially free to move, for example via a cut-out region 126 partially encompassing the locking tab 120.

In this embodiment, the umbrella base clamp assembly 100 also comprises a plurality of locking channels 122 arranged about an inner surface of the base 106 and positioned so as to engage with the one or more locking tabs 120 when the stem 102 is engaged with the base 106. In one embodiment, the locking channels 122 are arranged as generally vertically extending grooves in a spline-type arrangement. In this embodiment, each locking channel 122 is bounded and defined by adjacent locking ridges 124. As the stem 102 is engaged with the base 106 via threaded engagement at the threaded portions 110, 112, the one or more locking tabs 120 will alternately engage and disengage with respective locking channels 122 as the stem 102 is rotated into engagement with the base 106. As the locking tabs 120 are resiliently biased or preloaded to move outward from a longitudinal axis of the stem 102 and pole 104, appropriate rotational orientation of the stem 102 with the base 106 will allow the locking tab 120 including a corresponding protrusion 123 of the locking tab, to engage with a respective locking channel 122.

Figure 5:
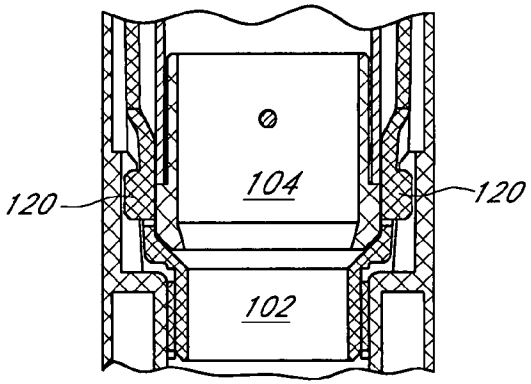
FIG. 5 is a side section view of the embodiment of FIG. 4 in a clamped or secured configuration.
Figure 3:
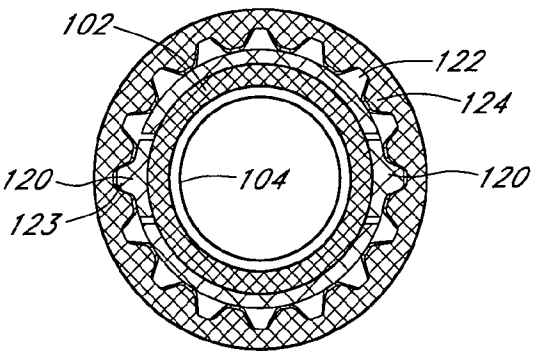
FIG. 3 is a top cross-section view of one embodiment of an umbrella base clamp, the section being taken through a protrusion of the clamp.
Figure 4:
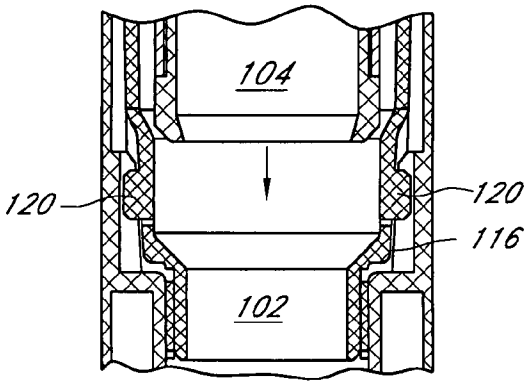
FIG. 4 is a side section view of one embodiment of an umbrella base clamp in a partially secured configuration.
Figure 2:
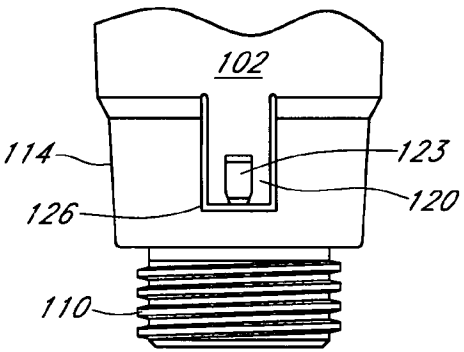
FIG. 2 is a side view of one embodiment of a stem of an umbrella base clamp.
Figure 9:
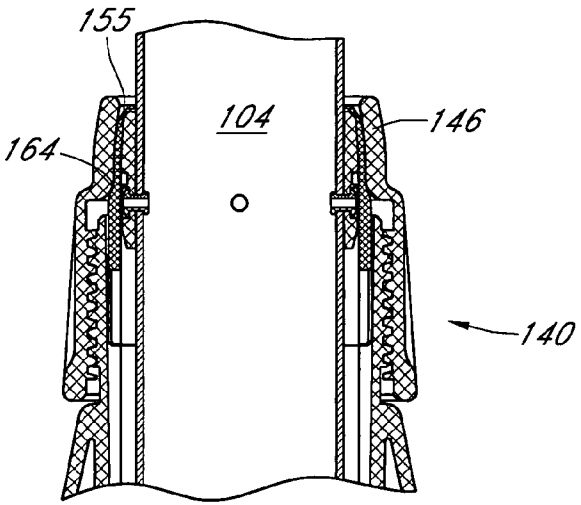
FIG. 9 is a side section view of the embodiment of FIG. 8 in a clamped or secured configuration.
Figure 7:
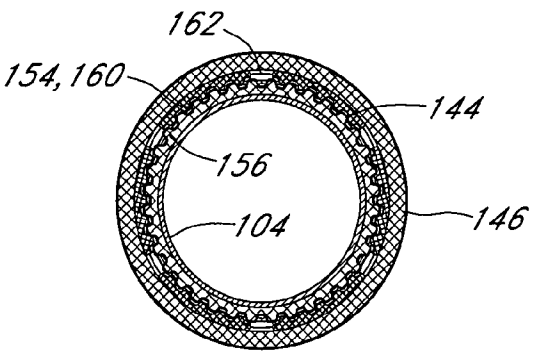
FIG. 7 is a top or elevation section view of another embodiment of an umbrella base clamp.
Figure 8:
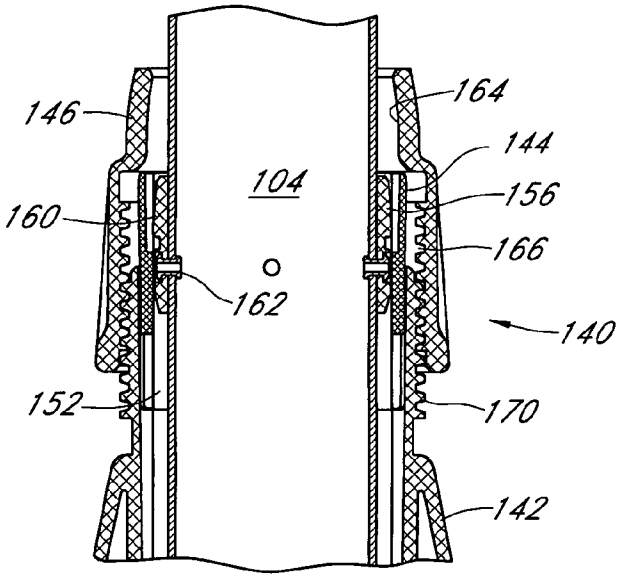
FIG. 8 is a side section view of another embodiment of an umbrella base clamp in a partially engaged or secured configuration.

In this embodiment, the umbrella base clamp assembly 100 is further configured to lock the locking tab or tabs 120 with protrusions 123 engaged with respective locking channels 122. More particularly, the stem 102 is configured to receive the umbrella pole 104 in an interior of the stem 102. As shown by the arrow in FIG. 4 and as further shown in FIG. 5, as the pole 104 is insertable into the stem 102 such that the lower end of the pole 104 rests between opposed locking tabs 120. The stem 102 and pole 104 can be dimensioned such that the pole 104 fits snugly within the stem 120. The pole 104 also can be arranged between inner surfaces of the opposed locking tabs 120 to block further inward movement of these tabs 120 from their outward biased positions. At least on this sense, the protrusions 123 are configured to be urged away by the pole from a longitudinal axis of the pole 104 and into engagement with one or more channels 122.

Insertion of the pole 104 into the stem 102 thereby blocks further inward movement of the locking tabs 120 to thereby secure the locking tabs 120 in the corresponding locking channels 122. Thus, when the stem 102 is fully engaged with the base 106 and the pole 104 is inserted within the interior of the stem 102, further rotation between the stem 102 and the pole 104 relative to the base 106 is restrained by the locking tabs 120 engaging their corresponding protrusions 123 with corresponding locking channels 122 of the base 106. Again, the pole 104 substantially prevent inward movement of the locking tabs 120 in one arrangement and the stem 102 and attached pole 106 are thereby rotationally fixed with respect to the base 106.

One embodiment further comprises a second umbrella base clamp assembly 140 as illustrated in FIGS. 1 and 6-13. The umbrella base clamp assembly 140 is configured to further restrain or limit unwanted rotational movement between the umbrella pole 104 and the base 106. In one embodiment, the umbrella base clamp 140 is arranged at a position intermediate the lower end of the umbrella pole 104 and an upper end thereof.

In one embodiment, the stem 102 further comprises a pedestal 142 extending upwardly generally from a central position of the base 106 when the stem 102 is coupled with the base 106. The pedestal 142 defines a plurality of securing structures or ribs 152 which in one embodiment extend generally vertically and are positioned at an inner surface and upper end of the pedestal 142. In one embodiment, the pedestal 142 also defines threads 170 arranged at an upper and outer surface of the pedestal 142. FIG. 1 shows that the pedestal 142 can be configured with a wide base to spread the load of the umbrella pole 104, which can be heavy in some embodiments, as discussed below. For example the pedestal 142 can have an enlarged lower portion that abuts an upper surface of the base 106. In one embodiment, the pedestal 142 abuts a ring shaped area of the base 106 surrounding a recess in the base 106 into which the stem 102 can be inserted upon assembly. The pedestal 142 also can comprise the stem 102, e.g., at a lower portion thereof.

In one embodiment, the umbrella base clamp 140 also comprises a collet or wedge structure 144. In one embodiment, the collet 144 is configured as a generally hollow cylindrical structure defining a plurality of notches 150 at a lower end thereof. The notches 150 are configured and dimensioned to engage with the ribs 152 of the pedestal 142 to thereby support and inhibit rotational movement between the collet 144 and the pedestal 142. The collet 144 further defines one or more flexible fingers 155 which define a plurality of internal splines 154 at an upper and inner surface of the collet 144.

In one embodiment, the umbrella base clamp assembly 140 also comprises a pole cuff 156 which is configured and dimensioned to fit securely around or to surround the pole 104. The cuff 156 further defines a plurality of cuff splines 160 which are configured and dimensioned to cooperatively engage with the collet splines 154 of the collet 144. The pole cuff 156 is engaged and secured with the pole 104. In one embodiment, this attachment is provided by one or more pole fixations 162 such as threaded fasteners, rivets, ultrasonic welds, adhesives, and/or friction fit.

The umbrella base clamp 140 also comprises a clamp collar 146 which defines collar threads 166 generally at a lower and interior surface thereof. The collar threads 166 of the clamp collar 146 are configured to cooperatively engage with the pedestal threads 170. The clamp collar 146 also defines an engagement profile 164 which is configured and dimensioned to engage with the collet or wedge 144 to further resist unwanted rotational movement between the pole 104 and the base 106. More particularly, in one embodiment a collet or wedge 144 is positioned around the pole 104 and within the upper interior of the pedestal 142. The collet or wedge 144 is further arranged such that the notches 150 of the collet 144 engage with the corresponding ribs 152 of the pedestal 142. The collet or wedge 144 is thereby supported by the pedestal 142 and further in a manner such that the engagement of the ribs 152 with the notches 150 resists or inhibits further rotation of the collet 144 with respect to the base 106. The collet splines 154 are positioned adjacent corresponding cuff splines 160 of the pole cuff 156, however, prior to engagement of the base clamp assembly 140, the corresponding splines 154, 160 are not engaged.

In one embodiment, a clamp collar 146 is further positioned and manipulated such that the collar threads 166 engage with the pedestal threads 170. As the clamp collar 146 is thereby threaded into engagement with the pedestal 142, the engagement profile 164 engages into contact with the collet 144. The engagement profile 164 is configured such that the flexible fingers 155 move inward to engage the collet splines 154 with the cuff splines 160. As the pole cuff 156 is secured to the pole 104 via the one or more pole fixations 162, engagement of the collet splines 154 with the cuff splines 160 thereby inhibits further rotation of the pole 104 and attached cuff 156 with respect to the collet 144. The collet 144 is secured against further rotation with respect to the base 106 via engagement of the notches 150 with the ribs 152. The pole 104 is thereby secured against unwanted rotation with respect to the base 106 via the interposed collet 144.

In one embodiment, unwanted rotational movement between the pole 104 and base 106 is further inhibited via a wedging or friction engagement provided by the umbrella base clamp assembly 140. More particularly, the engagement profile 164 of the clamp collar 146 is configured such that the flexible fingers 155 are wedged into frictional engagement between the pole cuff 156 and the clamp collar 146. As the clamp collar 146 is threadedly engaged with the pedestal 142, this wedging or frictional engagement further inhibits unwanted rotation between the pole 104 and base 106.

Figure 6:
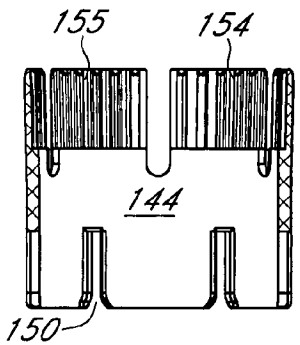
FIG. 6 is a side section view of one embodiment of a collet or wedge of an umbrella base clamp.
Figure 13:
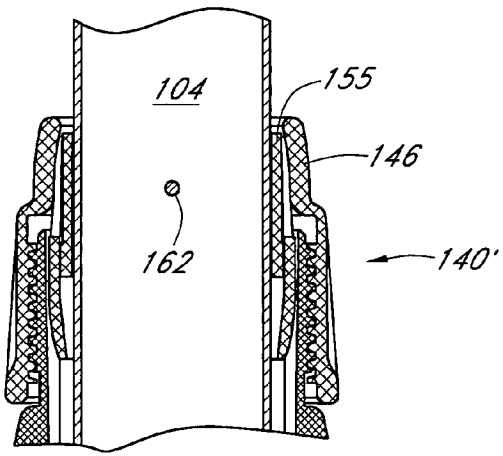
FIG. 13 is a side section view of the embodiment of FIG. 12 in a secured or clamped configuration.
Figure 11:
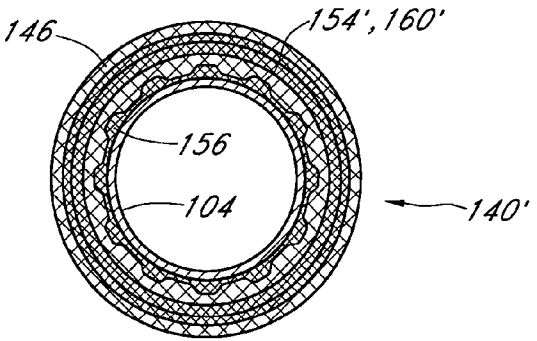
FIG. 11 is a top or elevation section view of another embodiment of an umbrella base clamp.
Figure 12:
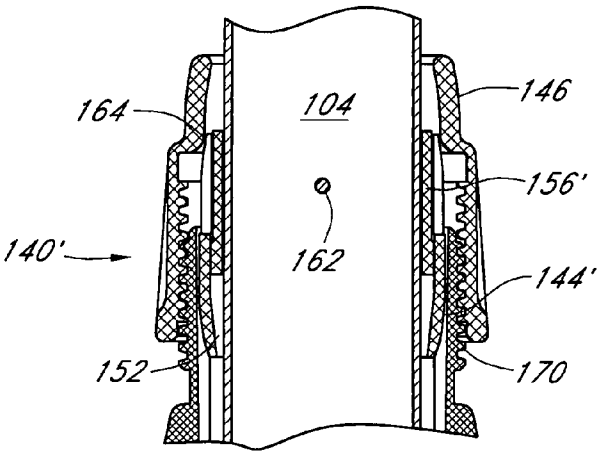
FIG. 12 is a side section view of another embodiment of an umbrella base clamp in a partially engaged or secured configuration.
Figure 10:
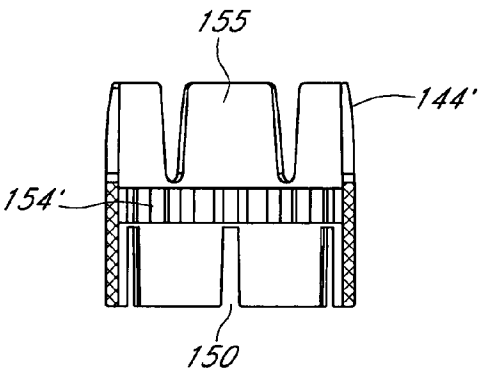
FIG. 10 is a side section view of another embodiment of a collet of an umbrella base clamp.

FIGS. 10-13 illustrate a further embodiment of an umbrella base clamp assembly 140'. The umbrella base clamp assembly 140' is configured and operates in a similar manner to that previously described for the umbrella base clamp assembly 140, however with a different configuration of a pole cuff 156' and collet 144'. FIGS. 6 and 10 illustrate differences between the collet 144 and collet 144'.

In one embodiment, collet splines 154' of the collet 144' are positioned about an interior surface of the collet 144', at an intermediate position between an upper and a lower end of the collet 144'. The collet 144 provides collet splines 154 generally positioned at an upper end of the collet 144. The configuration of corresponding cuff splines 160' is correspondingly adapted such that the collet splines 154' engage with the cuff splines 160'. Engagement of the base clamp assembly 140' otherwise proceeds in a similar manner to that previously described for the umbrella base clamp assembly 140.

Another difference however between the umbrella base clamp assembly 140 and the assembly 140' is that frictional engagement between the clamp collar 146, the collet 144', and the pole 106 occurs generally at an upper end of the collet 144' with less direct involvement of the splines 154', 160'. Engagement of the cooperating collet splines 154' and cuff splines 160' occurs at a generally intermediate position between an upper and lower end of the collet 144'. In the umbrella base clamp assembly 140, the frictional engagement between the flexible fingers 155 occurs at the same general upper end of the collet 144 as the engagement between the collet splines 154 and cuff splines 160.

Thus, various embodiments of the umbrella base clamps assembly 100, 140, 140' provide one or more structures or assemblies for securing a pole 104 to a base 106 to inhibit or secure against unwanted rotational movement therebetween once a connection is made. The umbrella base clamps assembly 100, 140, 140' are of relatively simple construction and do not require special tooling or particular skill for assembly or operation. The materials of the umbrella base clamps assembly 100, 140, 140' can be readily formed via inexpensive materials and fabrication techniques, such as with molded plastics. The umbrella base clamps assembly 100, 140, 140' are also aesthetically pleasing and unobtrusive as the securing structures are largely hidden from view and present an outward clean and mechanically uncluttered appearance. The umbrella base clamps assembly 100, 140, 140' also offer the advantage of releasability, for example via unthreading of the clamp collar 146 and withdrawal of the pole 104 from the base 106 to thereby facilitate exchange or replacement of parts. This aspect of the invention provides increased flexibility and utility to a user as compared to a permanent fixed connection between a pole and a base, for example via welding or permanent adhesives.

One environment in which the foregoing structures are particularly useful is in connection with a very large umbrella. For example, one umbrella that could incorporate the base designs discussed herein would have a transverse dimension or width of about thirteen feet or more and a height of about ten feet or more, e.g., about ten feet and six inches tall. Such an umbrella is relatively heavy, weighing about ninety pounds or more. As such, limiting unwanted relative rotational movement of components of the base and of base and the pole by the arrangements described herein is advantageous.

Although the foregoing description of the preferred embodiment of the present invention has shown, described, and pointed out the fundamental novel features of the invention, it will be understood that various omissions, substitutions, and changes in the form of the detail of the apparatus as illustrated, as well as the uses thereof, may be made by those skilled in the art without departing from the spirit of the present invention.

This disclosure includes all permutations of the independent claims with their dependent claims.

What is claimed is:

1. An umbrella base assembly comprising:

a base comprising a recess and at least one channel in the recess;

a coupler having a sleeve extending along a longitudinal axis and configured to receive an umbrella pole, the coupler having an outer surface having a fixed portion located at a first radial distance from the longitudinal axis and at least one movable protrusion coupled with a movable portion of said outer surface, the protrusion movable from a first position disposed radially outward from the fixed portion of the outer surface to a second position at least partially radially inward from the fixed portion of the outer surface;

a first clamping mechanism for preventing rotation of the coupler relative to the base, the first clamping mechanism comprising the at least one channel in the base and the at least one movable protrusion, the first clamping mechanism being actuated by inserting the umbrella pole into the sleeve to a position adjacent to the at least one movable protrusion; and a second clamping mechanism for preventing rotation of the umbrella pole relative to the coupler, the second clamping mechanism comprising a collar and a wedge member positionable at least partially within the collar, the second clamping mechanism being actuated by advancing the collar into engagement with the wedge member such that pressure is applied to the wedge member.

2. A support for an umbrella pole, the support comprising:

a base;

a pole comprising a longitudinal axis and extending between a lower end and an upper end, the pole being configured to be inserted into the base; and a clamp assembly for engaging the pole with the base comprising a plurality of vertically oriented channels protruding from an interior surface of the base and at least one protrusion configured to be urged by the pole away from the longitudinal axis and into engagement with one or more of the channels, wherein the at least one protrusion is adapted to rotate within the base when the pole is disengaged from the clamp assembly.

3. The umbrella pole support of claim 2, wherein rotation of the protrusion moves the protrusion from one of the vertically oriented channels to an adjacent vertically oriented channel.

4. The umbrella pole support of claim 2, wherein the clamp assembly comprises a separate stem engaged with the pole.

5. The umbrella pole support of claim 4, wherein engagement of the pole with the stem blocks the at least one protrusion in a position away from the longitudinal axis.

6. The umbrella pole support of claim 2, wherein two protrusions are provided on opposite sides of the pole.

7. The umbrella pole support of claim 2, further comprising cooperating tapered profiles between the clamp assembly and the base.

8. The umbrella pole support of claim 2, wherein the at least one protrusion comprises a cut out region of the clamp assembly around a locking tab and wherein a resilient material of the clamp assembly permits movement away from the longitudinal axis.

9. The umbrella pole support of claim 2, wherein the clamp assembly is a first clamp assembly and the support further comprises a second clamp assembly for engaging the base with the pole between the upper and lower ends of the pole.

10. The umbrella pole support of claim 9, wherein the second clamp assembly comprises a wedge member configured to transmit pressure to an outer surface of the pole.

11. The umbrella pole support of claim 10, further comprising cooperating spline structures arranged between the pole and the wedge member to engage when the wedge member is transmitting pressure to the outer surface.

12. The umbrella pole support of claim 9, further comprising a pedestal engaged with the base to extend upwards therefrom and wherein the second clamp assembly is arranged at an upper end of the pedestal.

13. The umbrella pole support of claim 9, wherein the second clamp assembly comprises a cuff which is attached to the pole.

14. A base assembly, comprising:

a base comprising a plurality of vertically oriented channels protruding from an inside surface thereof; and a coupler comprising:

a sleeve for receiving an umbrella pole;

a lower portion of the coupler comprising a side surface; and a locking member coupled with the side surface and configured to move toward or away from a longitudinal axis of the sleeve;

wherein the coupler has a first configuration in which the locking member is rotatable between adjacent vertically oriented channels and a second configuration in which the locking member is prevented from rotating between adjacent vertically oriented channels to prevent rotation of the coupler relative to the base.

15. A coupler for coupling a lower portion of an umbrella pole with a base, the coupler comprising:

a sleeve for receiving the umbrella pole;

a lower portion of the coupler comprising a side surface; and at least one protrusion movably coupled with the side surface to move away from a longitudinal axis of the sleeve such that the protrusion engages one of a plurality of vertically oriented channels disposed between locking ridges from an interior surface of the base in a first configuration;

wherein the at least one protrusion is movable by the locking ridges from the first configuration to a second configuration wherein the at least one protrusion is depressed towards the longitudinal axis of the sleeve.

16. The coupler of claim 15, further comprising a pedestal having an upper portion and a lower portion, the lower portion having a greater transverse size than the upper portion.

17. The coupler of claim 16, wherein the pedestal is configured to abut an annular surface of a base surrounding at least a portion of a base recess.

18. A coupler for coupling a lower portion of an umbrella pole with a base, the coupler comprising:

a sleeve for receiving the umbrella pole;

a lower portion of the coupler comprising a side surface;

at least one protrusion movably coupled with the side surface to move away from a longitudinal axis of the sleeve such that the protrusion engages the base, and a plurality of threads configured to releasably engage the coupler from corresponding threads in a base recess.

19. The coupler of claim 15, wherein the sleeve has a cross-sectional dimension that is slightly larger than the umbrella pole, such that when the umbrella pole is inserted into the sleeve, the at least one protrusion is prevented from moving toward the longitudinal axis of the pole.

20. The coupler of claim 15, wherein the lower portion comprises two protrusions.

21. The coupler of claim 15, wherein threads are formed on an upper portion of the coupler.

22. A support for an umbrella pole, the support comprising:

a base comprising a recess and a plurality of vertically oriented channels protruding from an inside surface thereof;

a pole comprising a longitudinal axis and extending between a lower end and an upper end, the pole being insertable into the recess; and means for coupling the pole with the base, the means for coupling rotatably engageable with the plurality of vertically oriented channels; and means for preventing relative rotation between the coupling means and the base, the means for preventing relative rotation being located in the recess.

23. The umbrella pole support of claim 2, wherein the pole is disengageable from the clamp assembly while leaving the clamp assembly in place at the base.

24. The umbrella pole support of claim 2, wherein the base is configured to support an attachable pole generally upright.

25. An anti-rotation umbrella assembly comprising:

a base having an upper portion, a lower portion and a recess extending therebetween;

a pole comprising a longitudinal axis and extending between a lower end and an upper end, the pole extending into the base within the recess to an elevation below the upper portion of the base; and a clamp assembly connected to the base for engaging the pole with the base comprising:

a plurality of vertically oriented channels protruding from an interior surface of the clamp assembly; and a protruding portion extending generally horizontally into the vertically oriented channels on opposite sides of the pole, coupling of the protruding portion with the vertically oriented channels preventing rotation of the pole relative to the base.

26. The anti-rotation umbrella assembly of claim 25, wherein the clamp assembly is at least partially located within a recess formed in the base.

27. The anti-rotation umbrella assembly of claim 25, wherein the protruding portion comprises a resilient construction that permits the protruding portion to move horizontally into and out of the vertically oriented channels.

28. The anti-rotation umbrella assembly of claim 25, wherein the base assembly comprises a first configuration in which the protruding portions of the clamp assembly are permitted to rotate relative to the vertically oriented channels and a second configuration in which the protruding portions are prevented from rotating relative to the vertically oriented channels, the second configuration corresponding to full insertion of the pole.

29. The coupler of claim 18, further comprising a pedestal having an upper portion and a lower portion, the lower portion having a greater transverse size than the upper portion.

30. The coupler of claim 18 wherein the coupler has a first configuration in which the at least one protrusion is rotatable between adjacent vertically oriented channels and a second configuration in which the at least one protrusion is prevented from rotating between adjacent vertically oriented channels to prevent rotation of the coupler within the base recess.

31. The umbrella base assembly of claim 1, the second clamping mechanism comprising a cuff coupled with the pole such that the cuff is prevented from rotating relative to the pole.

32. The umbrella base assembly of claim 31, the second clamping mechanism further comprising cooperating spline structures arranged between the cuff and the wedge member to engage when the collar is transmitting pressure to the wedge member.

33. The umbrella base assembly of claim 32, wherein a portion of the spline structure is located at an intermediate position of an internal surface of the wedge member.

34. The umbrella base assembly of claim 32, wherein a portion of the wedge member comprises one or more flexible fingers, at least a portion of the spline structure being located on the one or more flexible fingers.

35. The umbrella base assembly of claim 1, wherein the second clamp assembly is arranged at an upper end of a pedestal engaged with the base, the wedge member engaged with one or more ribs formed on the pedestal, the engagement preventing rotation of the wedge member relative to the base.

* * * * *

UNITED STATES PATENT AND TRADEMARK OFFICE

CERTIFICATE OF CORRECTION

PATENT NO. : 7,784,761 B2
APPLICATION NO. : 11/357514
DATED : August 31, 2010
INVENTOR(S) : Oliver Joen-an Ma It is certified that error appears in the above-identified patent and that said Letters Patent is hereby corrected as shown below:

At column 9, line 13 (approx.), in Claim 15, after "ridges" insert --protruding--.

Signed and Sealed this
Seventeenth Day of May, 2011

David J. Kappos

David J. Kappos
*Director of the United States Patent and Trademark Office*